US007506955B2

(12) United States Patent
Yamamoto et al.

(10) Patent No.: US 7,506,955 B2
(45) Date of Patent: Mar. 24, 2009

(54) LIQUID EJECTION APPARATUS AND CLEANING METHOD FOR LIQUID EJECTION APPARATUS

(75) Inventors: Taisuke Yamamoto, Nagano-ken (JP); Yoshiharu Aruga, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 413 days.

(21) Appl. No.: 11/352,211

(22) Filed: Feb. 13, 2006

(65) Prior Publication Data

US 2006/0214982 A1 Sep. 28, 2006

(30) Foreign Application Priority Data

Feb. 14, 2005 (JP) ..... 2005-036465

(51) Int. Cl.
*B41J 2/165* (2006.01)
*B41J 2/195* (2006.01)
*B41J 2/175* (2006.01)

(52) U.S. Cl. ..... 347/23; 347/7; 347/29; 347/30; 347/32; 347/86

(58) Field of Classification Search ..... 347/7, 347/19, 22, 23, 29, 30, 32, 33, 35, 86, 92
See application file for complete search history.

(56) References Cited

U.S. PATENT DOCUMENTS 6,000,792 A * 12/1999 Koizumi et al. ..... 347/89

FOREIGN PATENT DOCUMENTS

| | | | | |
|---|---|---|---|---|
| EP | 0 615 846 A1 | | 9/1994 | |
| JP | 401080544 A | * | 3/1989 | ..... 347/92 |
| JP | 2000-352379 A | | 12/2000 | |
| JP | 2004-90453 A | | 3/2004 | |
| JP | 2004-299183 A | | 10/2004 | |

* cited by examiner

*Primary Examiner*—Shih-wen Hsieh
(74) *Attorney, Agent, or Firm*—Sughrue Mion, PLLC

(57) ABSTRACT

Liquid is sent from a liquid retainer to a liquid ejection head via a liquid supply line by pressurization force generated by a pressurization device that is driven by a driver. A method for cleaning a liquid ejection apparatus includes drawing the liquid from the liquid ejection head through a nozzle by a suction device; and obtaining a liquid remaining amount of the liquid retainer. The method further includes determining an operational speed of the driver in correspondence with a result of the calculation; and operating the driver at the determined operational speed when drawing the liquid by the suction device. Thus, liquid is consumed completely without being wasted.

12 Claims, 9 Drawing Sheets

LIQUID EJECTION APPARATUS AND CLEANING METHOD FOR LIQUID EJECTION APPARATUS

CROSS-REFERENCE TO RELATED APPLICATIONS

This application is based upon and claims the benefit of priority from prior Japanese Patent Applications No. 2005-36465, filed on Feb. 14, 2005, the entire contents of which are incorporated herein by reference.

BACKGROUND OF THE INVENTION

The present invention relates to liquid ejection apparatuses such as inkjet printers and cleaning methods for liquid ejection apparatuses.

As a liquid ejection apparatus that ejects liquid from a liquid ejection head to a target, an inkjet recording apparatus (hereinafter, a "printer"), for example, is known. The printer includes an ink cartridge (a liquid retainer) and a recording head (a liquid ejection head) mounted on a carriage. The ink cartridge retains ink (liquid) and supplies the ink to the recording head. Normally, the printer includes a pressurization pump (a pressurization device) that sends pressurized air to the ink cartridge. This pressurizes the ink retained in an ink pack accommodated in the ink cartridge and thus sends the ink to the recording head. The ink is then ejected onto a recording medium (a target) through a nozzle of the recording head, thus subjecting the medium to printing (see, for example, Japanese Laid-Open Patent Publication No. 2000-352379).

The recording head has a piezoelectric element as well as the nozzle. When the piezoelectric element is actuated, the ink is introduced into the nozzle and then ejected from an opening defined in the nozzle. The solvent of the ink thus may easily evaporate from the opening of the nozzle. Further, the viscosity of the ink may be increased in the nozzle and thus clog the nozzle. Also, the atmospheric air may enter the nozzle from the nozzle opening and mix with the ink, generating bubbles in the ink. The bubbles may cause a printing problem such as a missing dot. To avoid these problems, printer cleaning methods including choke cleaning methods or selective cleaning methods have been known (see, for example, Japanese Laid-Open Patent Publication No. 2004-90453).

In choke cleaning, a valve (an open-close valve) located upstream from the recording head is closed. A nozzle surface of the recording head is then subjected to suction by a suction pump (a suction device), generating negative pressure in the recording head. The bubbles in the recording head are thus expanded. Subsequently, the valve (the open-close valve) is opened and allows the ink to rapidly flow into the recording head. The ink having the increased viscosity and the expanded bubbles are thus drained from the nozzle, or the recording head.

The pressurization pump of Japanese Laid-Open Patent Publication No. 2000-352379 may be connected to the ink cartridge of Japanese Laid-Open Patent Publication No. 2004-90453. If the choke cleaning is performed on this printer, the valve is normally opened through pressurization by the pressurization pump. Since the pressurization pump is formed by a diaphragm type that pressurizes the valve in accordance with each stroke, the pressure in the ink cartridge increases in a stepped manner. Further, the amount of the ink consumed in each cycle of the choke cleaning cycle is normally measured as being the same as a fixed basic value, which corresponds to the amount of the ink consumed in a single choke cleaning cycle performed when the ink pack is full.

However, if the amount of the ink remaining in the ink pack decreases, the volume of the air retained in the ink cartridge correspondingly increases. The efficiency of pressurization by the pressurization pump in accordance with the stroke movement of the pressurization pump is thus lowered. This prolongs the time for raising the pressure of the pressurization pump to a level sufficiently high for opening the valve, and thus decreases the (actual) drainage amount of the ink. In other words, since the actuation time of the pressurization pump is constant, the time for drawing (draining) the ink is shortened if the prolonged time is necessary for sufficiently raising the pressure of the pressurization pump.

As a result, as the ink remaining amount of the ink pack becomes smaller, the difference between the actual ink consumption amount of the choke cleaning and the value determined in correspondence with the fixed basic value becomes greater. The ink thus unnecessarily remains unused, or is wasted, by an amount corresponding to the difference.

SUMMARY OF THE INVENTION

It is an objective of the present invention to provide a liquid ejection apparatus and a cleaning method for the liquid ejection apparatus in which liquid is consumed completely without being wasted.

To achieve the above-mentioned objective, the present invention provides a method for cleaning a liquid ejection apparatus having a liquid ejection head that ejects liquid through a nozzle. The liquid is sent from a liquid retainer to the liquid ejection head via a liquid supply line by pressurization force generated by a pressurization device that is driven by a driver. The method includes drawing the liquid from the liquid ejection head through the nozzle by a suction device; and obtaining a liquid remaining amount of the liquid retainer. The method further includes determining an operational speed of the driver in correspondence with a result of the calculation; and operating the driver at the determined operational speed when drawing the liquid by the suction device.

Further, the present invention provides a liquid ejection apparatus including a liquid retainer. A liquid ejection head has a nozzle through which liquid is ejected and a nozzle surface in which an opening of the nozzle is defined. A liquid supply line extends from the liquid retainer to the liquid ejection head. A pressurization device pressurizes the liquid so as to introduce the liquid from the liquid retainer into the liquid supply line and thus eject the liquid from the liquid ejection head. A driver drives the pressurization device. A seal device seals the nozzle surface. A suction device draws the liquid from the liquid supply line and the liquid ejection head through the seal device. A calculating section calculates a liquid remaining amount of the liquid retainer. A determining section determines an operational speed of the driver based on a result of the calculation by the calculating section. A control section controls the driver at the determined operational speed when the liquid is drawn by the suction device.

Further, the present invention provides an inkjet printer including a cartridge and a recording head. The recording head has a nozzle through which ink is ejected and a nozzle surface in which an opening of the nozzle is defined. An ink supply line extends from the cartridge to the recording head. A pressurization pump pressurizes the ink so as to introduce the ink from the cartridge into the ink supply line and thus eject the ink from the recording head. The inkjet printer further includes a pressurization motor for driving the pressurization pump; a cap for sealing the nozzle surface; and a suction pump for drawing the ink from the ink supply line and the recording head through the cap. A control section controls the pressurization motor. The control section calculates an ink remaining amount of the cartridge, determines an operational speed of the pressurization motor based on a result of the calculation, and operates the pressurization motor at the determined operational speed when the ink is drawn by the suction pump.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

An inkjet printer according to an embodiment of the present invention will hereafter be described with reference to FIGS. 1 to 10.

Figure 1:
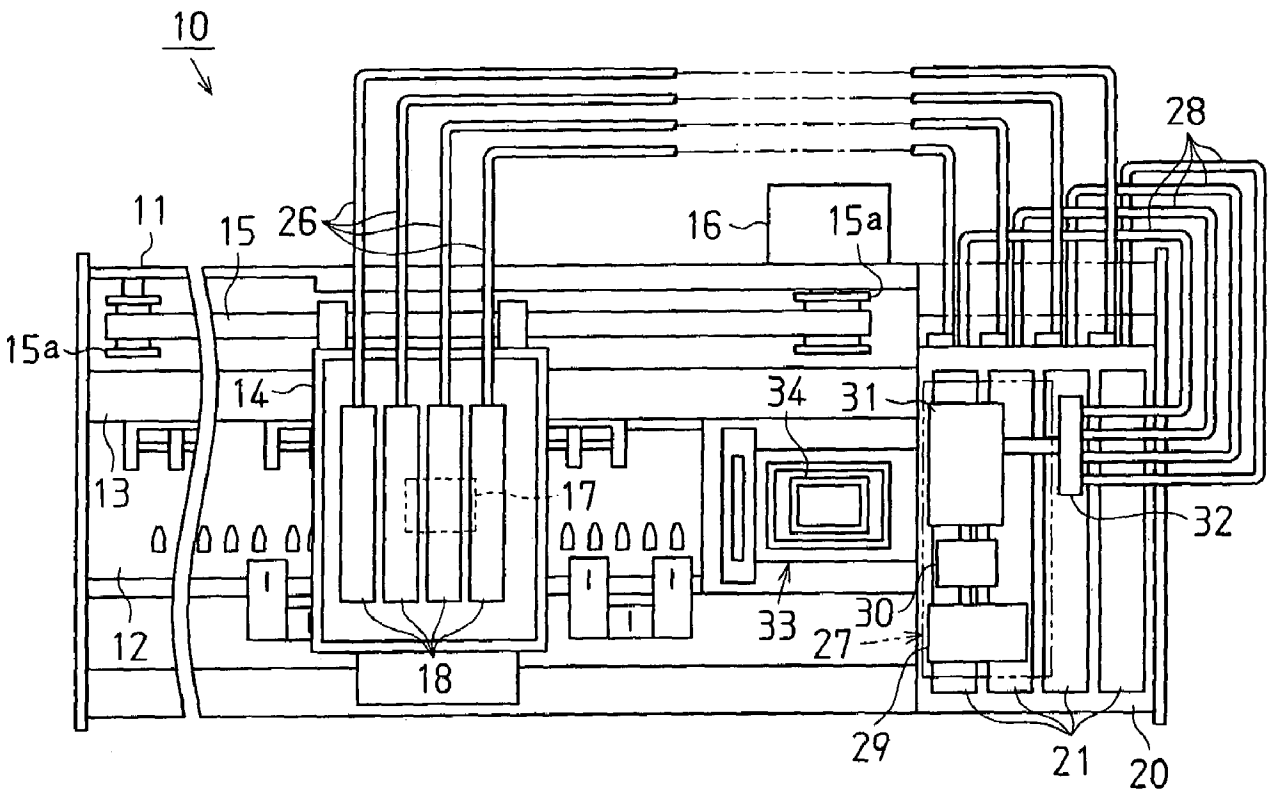
FIG. 1 is a plan view showing an inkjet printer according to an embodiment of the present invention.

As shown in FIG. 1, an inkjet printer 10 serving as a liquid ejection apparatus includes a frame 11 and a platen 12 supported by the frame 11. A paper feeder mechanism having a paper feeder motor M2 (see FIG. 9) feeds sheets of recording paper (not shown) to the platen 12. A rod-like guide member 13 is supported also by the frame 11 and extends parallel with the longitudinal direction of the platen 12.

A carriage 14 is supported by the guide member 13, which is passed through the carriage 14 in a manner movable along the axial direction of the guide member 13. The carriage 14 is connected to a carriage motor 16 through a timing belt 15 that is wound around a pair of pulleys 15*a*. Thus, when the carriage motor 16 runs, the carriage 14 reciprocates along the guide member 13.

A recording head 17 serving as a liquid ejection head is formed in a surface of the carriage 14 opposed to the platen 12. A plurality of (in the illustrated embodiment, four) valve units 18 are mounted on the carriage 14 in correspondence with the number of colors (types) of the ink employed by the printer 10. Each of the valve units 18 temporarily retains the ink, which is liquid, and supplies the ink to the recording head 17. Nozzles 19 (FIG. 3) are formed in a lower surface of the recording head 17. The ink is thus ejected as droplets from the nozzles 19 onto the recording paper, which has been fed to the platen 12.

Figure 2:
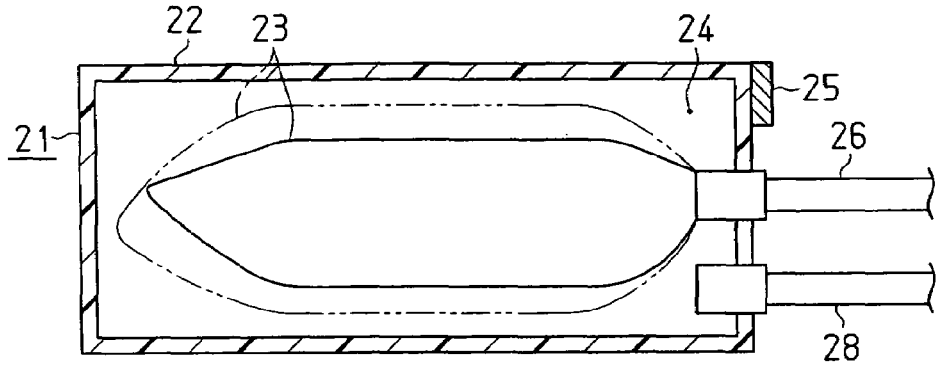
FIG. 2 is a cross-sectional view showing a cartridge of the printer of FIG. 1.

A cartridge holder 20 is arranged at a right end of the frame 11, as viewed in FIG. 1. A plurality of (in the illustrated embodiment, four) cartridges 21 serving as liquid retainers are separably held in the cartridge holder 20. As shown in FIG. 2, each of the cartridges 21 includes a casing 22 having a rectangular cross-sectional shape. An air chamber 24 is defined in the casing 22 of each cartridge 21 and accommodates an ink pack 23. The ink packs 23 of the cartridges 21 retain ink of different colors.

An IC chip 25 serving as a record device is secured to an outer surface of the casing 22 of each cartridge 21. Each of the IC chips 25 is electrically connected to an ASIC 76 (see FIG. 9) of the printer 10, when the cartridges 21 are installed in the cartridge holder 20. Each IC chip 25 stores information regarding an initial amount of the ink retained in the associated ink pack 23 before the initial use of the ink and an ink consumption amount of the ink pack 23.

Each of the ink packs 23 is formed of a flexible film having a bag-like shape. The interior of each ink pack 23 is filled with the ink. In FIG. 2, an ink filled state (in which an ink remaining amount is maximum, or coincides with the initial amount) of the ink pack 23 is indicated by the double-dotted broken lines. An ink consumed state of the ink pack 23 in which the ink amount of the ink pack 23 is decreased to a certain level is indicated by the solid lines. Each of the ink packs 23 is connected to the corresponding one of the valve units 18 mounted on the carriage 14 through an ink supply line 26, which defines a liquid supply line.

A pressurization unit 27 is arranged in the vicinity of the cartridge holder 20 in a right portion of the frame 11, as viewed in FIG. 1. The pressurization unit 27 introduces pressurized air into the air chamber 24 of each cartridge 21 through an air supply line 28. The pressurization unit 27 includes a pressurization pump 29 serving as a pressurization device, a pressure sensor 30, and an open-to-air valve 31. The air supply line 28 is divided into a plurality of (in the illustrated embodiment, four) branches at a divider 32, which is located downstream from the open-to-air valve 31. Each of the four branches of the air supply line 28 is connected to the corresponding one of the cartridges 21.

A distal end of each branch of the air supply line 28 extends through the casing 22 of the corresponding cartridge 21 and is thus received in the air chamber 24. Thus, when the pressurization pump 29 of the pressurization unit 27 is actuated, the pressurized air from the pressurization pump 29 is introduced into the air chamber 24 of each cartridge 21 through the air supply line 28. The pressure of the pressurized air then squeezes the ink pack 23 of each cartridge 21 and thus supplies the ink from the ink pack 23 to the corresponding valve unit 18 through the corresponding ink supply line 26.

Figure 3:
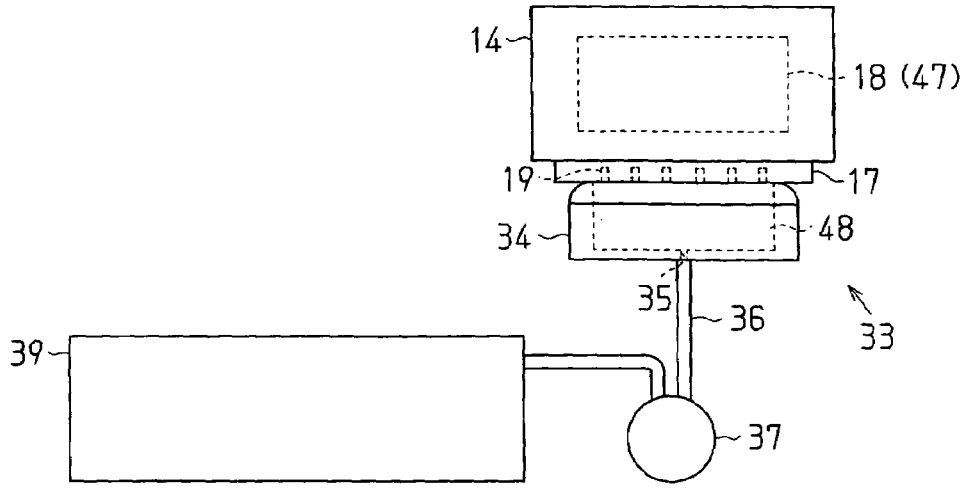
FIG. 3 is a diagram schematically showing a maintenance unit of the printer of FIG. 1.
Figure 9:
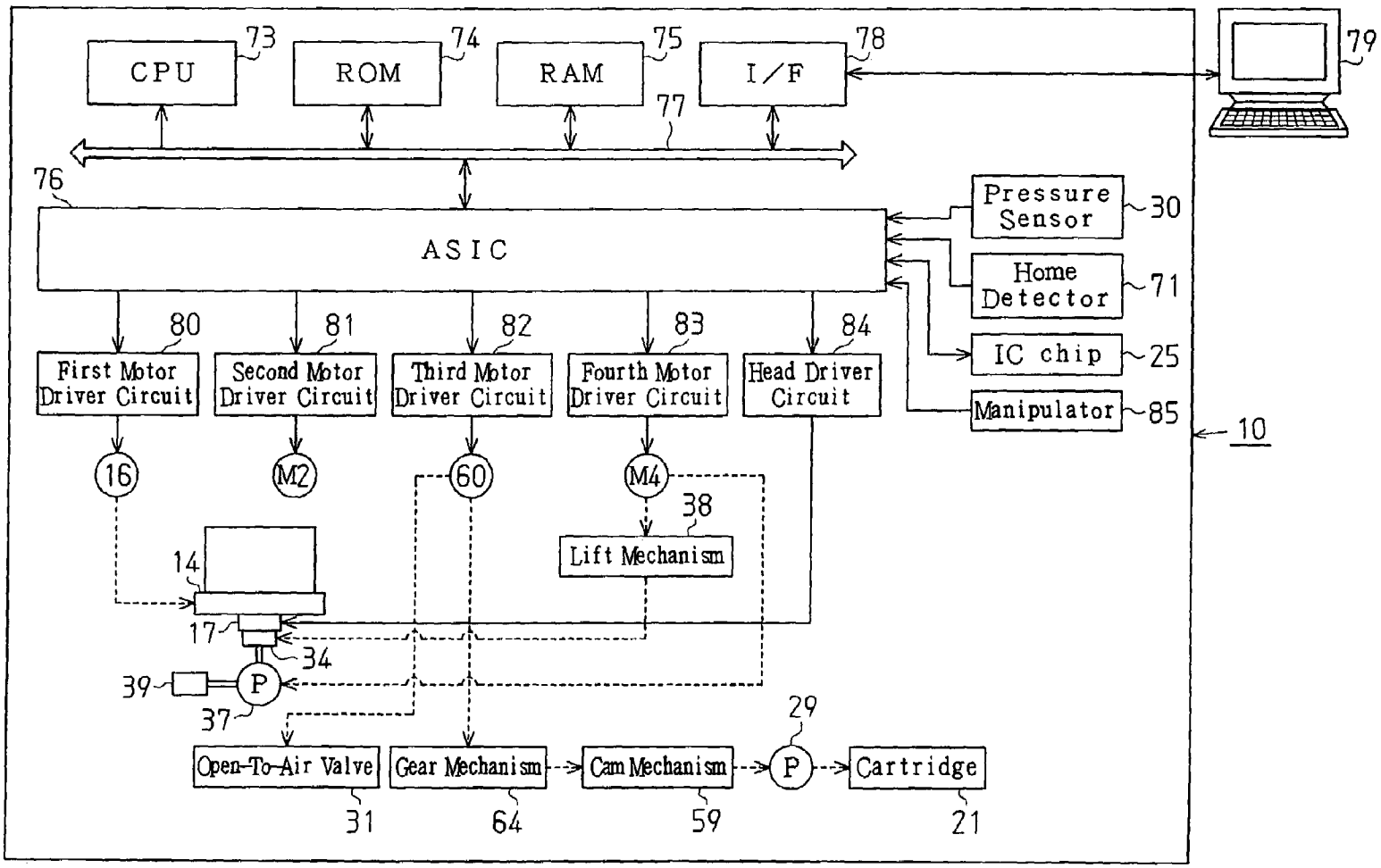
FIG. 9 is a block diagram showing the electric configuration of the printer of FIG. 1.

A maintenance unit 33 is arranged in the frame 11 at a position close to the right end of the frame 11. The position of the maintenance unit 33 coincides with a home position of the carriage 14. As shown in FIG. 3, the maintenance unit 33 includes a cap 34, a seal device. The cap 34 has a rectangular box-like shape with an upper opening. The cap 34 is connected to a lift mechanism 38 (see FIG. 9). The lift mechanism 38 has a gear mechanism and a cam mechanism (neither is shown), which are driven by a maintenance motor M4 (FIG. 9). When the carriage 14 is located at the home position, the lift mechanism 38 raises the cap 34 to a position at which the cap 34 contacts the lower surface of the recording head 17. The cap 34 thus airtightly seals the nozzles 19 of the recording head 17. That is, the cap 34 seals a nozzle surface of the recording head 17 in which an opening of the nozzle is defined.

An outlet hole 35 is defined in the bottom of the cap 34. An outlet tube 36 is connected to the outlet hole 35. A suction pump 37 serving as a suction device is arranged in an intermediate section of the outlet tube 36. The suction pump 37 is formed by a tube pump or a gear pump driven by the maintenance motor M4, which is a common drive source. The distal end of the outlet tube 36 is connected to a waste ink tank 39. The maintenance unit 33 performs choke cleaning using the valve units 18 mounted on the carriage 14.

Figure 4:
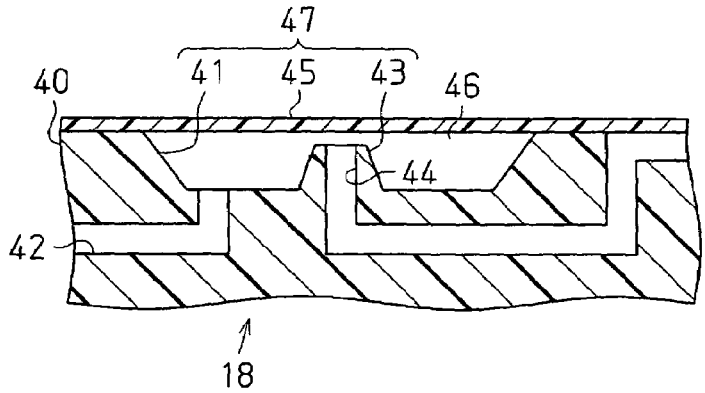
FIG. 4 is a cross-sectional view showing a main portion of a valve unit of the printer of FIG. 1, in which a choke valve is held in an open state.

As shown in FIG. 4, each valve unit 18 has a base 40 formed of synthetic resin. A recess 41 is defined in a side surface of the base 40. An inlet line 42 extends through the base 40 and has an opening corresponding to the bottom of the recess 41. The inlet line 42 communicates with the ink supply line 26 connected to the cartridges 21. A projection 43 projects from the bottom of the recess 41. An outlet line 44 extends through the base 40 and has an opening corresponding to an upper, or distal, end of the projection 43. The outlet line 44 communicates with the recording head 17.

A flexible film 45 is secured to the side surface of the base 40 of each valve unit 18 with slack. The film 45 seals the recess 41 and thus defines a pressure chamber 46 sealed by the inner wall of the recess 41 and the film 45. When the ink is supplied from the ink supply line 26 to each valve unit 18, the ink flows into the pressure chamber 46 through the inlet line 42.

As the amount of the ink in the pressure chamber 46 increases, the pressure of the ink acts on the film 45 to separate the film 45 from the projection 43 as shown in FIG. 4. If the ink amount of the pressure chamber 46 further increases and the pressure acting on the film 45 increases correspondingly, the film 45 deforms upwardly. In the illustrated embodiment, the recess 41, the film 45, the projection 43 and the like form a choke valve 47 serving as a pressure difference open-close valve. The inlet line 42, the recess 41, and the outlet line 44 form the liquid supply line together with the ink supply line 26.

Choke cleaning will hereafter be explained.

In choke cleaning, the suction pump 37 is actuated with the cap 34 held in contact with the lower surface of the recording head 17 as shown in FIG. 3. The air and the ink are thus drawn and drained from a cap interior 48 that is defined by the lower surface of the recording head 17 and the inner walls of the cap 34. The pressure in the cap interior 48 thus becomes negative and the negative pressure is supplied to the nozzles 19 of the recording head 17. This discharges the ink from the recording head 17 to the cap interior 48 through the nozzles 19.

Figure 5:
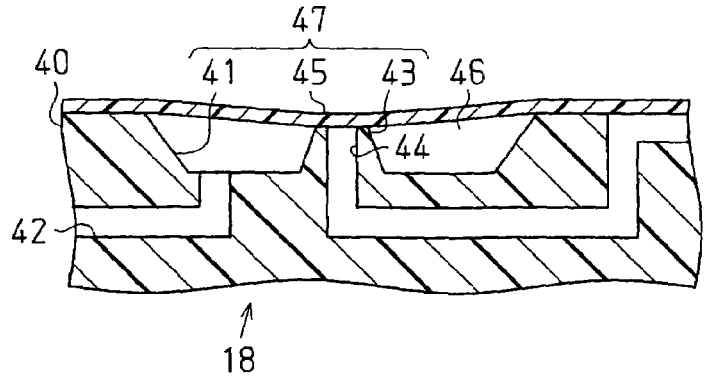
FIG. 5 is a cross-sectional view showing the main portion of the valve unit of the printer of FIG. 1, in which the choke valve is held in a closed state.

As the suction pump 37 continuously runs, the ink is drawn from the valve units 18, as well as the recording head 17. That is, in each of the valve units 18, the ink is drained from the pressure chamber 46 to a downstream side through the outlet line 44. This reduces the amount of the ink in the pressure chamber 46, causing the film 45 to deform toward the projection 43. The film 45 thus contacts the projection 43 and closes the outlet line 44 as shown in FIG. 5. In this state, by continuously operating the suction pump 37, a downstream side from the inlet of the outlet line 44 is further depressurized.

When the negative pressure is accumulated to a certain extent in the downstream side from the inlet of the outlet line 44, the pressurization pump 29 is activated. This causes the ink to flow from the cartridges 21 to the valve units 18, thus introducing the ink into the pressure chambers 46. As the amount of the ink in each of the pressure chambers 46 increases and the pressure of the ink cancels the negative pressure in the pressure chamber 46, the film 45 deforms to separate from the projection 43, thus opening the outlet line 44.

As a result, the ink rapidly flows into the outlet line 44 in which the negative pressure has been accumulated. The rapid ink flow removes the bubbles and the ink having increased viscosity from a downstream side from the ink supply line 26 and the pressure chambers 46 through the nozzles 19 of the recording head 17. In this manner, the choke cleaning is completed. The ink discharged from the nozzles 19 of the recording head 17 is sent to the waste ink tank 39.

The pressurization unit 27 will now be explained.

Figure 6:
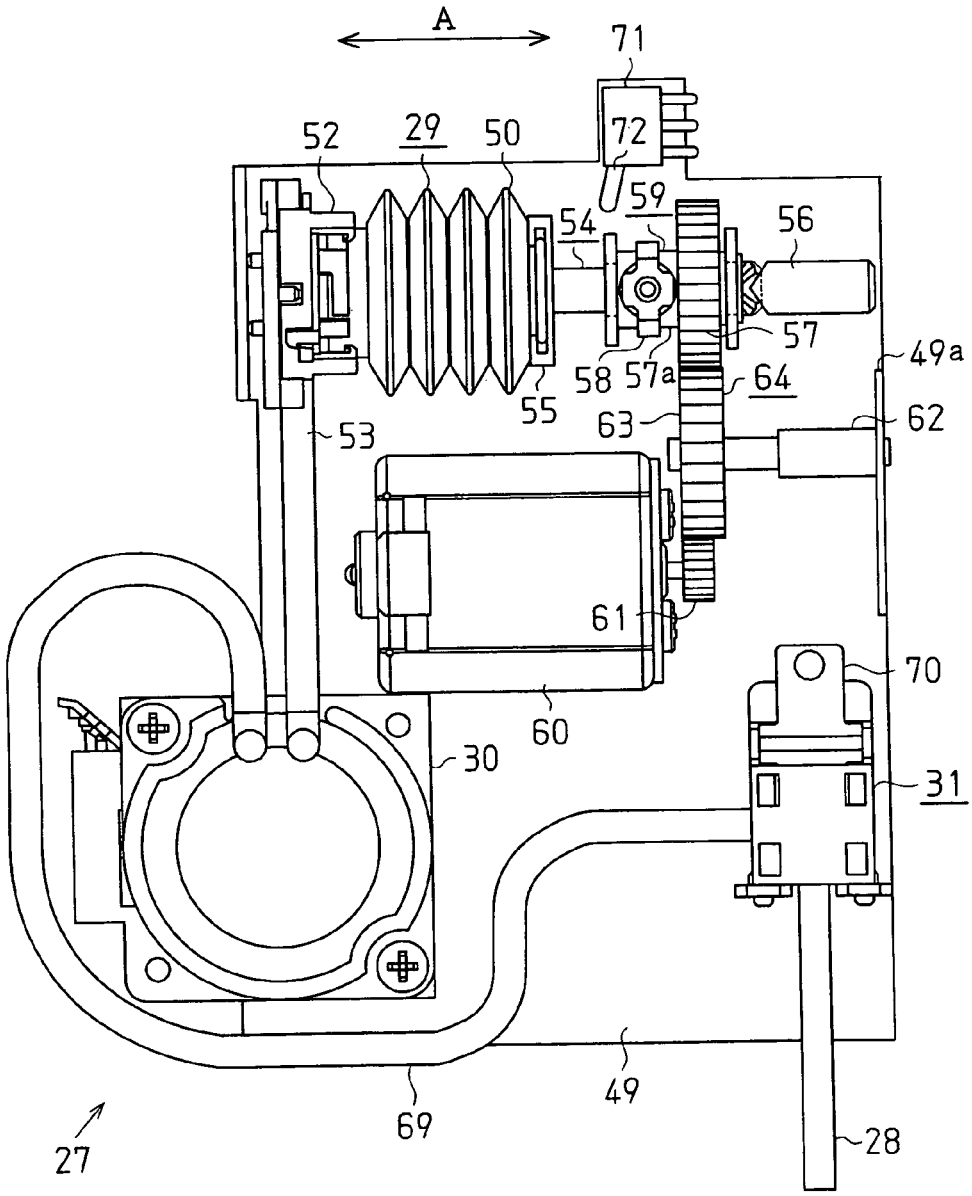
FIG. 6 is a plan view showing a pressurization unit of the printer of FIG. 1.

As shown in FIG. 6, the pressurization pump 29, the pressure sensor 30, and the open-to-air valve 31 are secured to an attachment plate 49 in such a manner as to form a unit. The pressurization pump 29 is a bellows type pump (a volume type pump) and has a flexibly deformable member 50, or bellows, formed of synthetic resin. The deformable member 50 is shaped as a lidded cylinder having a bellows-like side wall. An air accumulation chamber 51 (see FIG. 7) is defined in the deformable member 50 and sealed by a seal portion 52. An air outlet tube 53 is connected to the seal portion 52 and thus sends the pressurized air from the pressurization pump 29.

A pressing member 54 is fitted into a distal end of the deformable member 50. The pressing member 54 has a flat base 55 and a piston 56 formed integrally with the base 55. A non-illustrated cam groove is defined in an outer circumferential surface of the piston 56. The pressing member 54 further includes a first gear 57 through which the piston 56 is passed. The first gear 57 is supported in a manner rotatable about the axis of the piston 56 and relative to the piston 56.

A slidable portion 58 is arranged between the base 55 and the first gear 57. The slidable portion 58 is secured to a projection **57*a* projecting integrally from the first gear 57. A projection (not shown) projects from a rear side of the slidable portion 58 and slides along the cam groove of the outer circumferential surface of the piston 56. When the first gear 57 rotates about the axis of the piston 56, the slidable portion 58 revolves about the axis of the piston 56. This causes the projection of the slidable portion 58 to slide along the cam groove of the piston 56. Accordingly, in correspondence with the shape of the cam groove, the piston 56 linearly reciprocates in the axial direction of the piston 56 (as indicated by arrows A in FIG. 6**).

The linear reciprocation of the piston 56 flexibly deforms the deformable member 50 that is engaged with the base 55. This selectively increases and decreases the volume of the air accumulation chamber 51, thus sending the air to the air outlet tube 53. In the illustrated embodiment, the piston 56 and the slidable portion 58 form a cam mechanism 59.

A pressurization motor 60 is also secured to the attachment plate 49 and functions as a driver, or the drive source of the pressurization pump 29. The pressurization motor 60 is rotatable in opposing directions. A motor gear 61 is connected to the output shaft of the pressurization motor 60. A wall **49*a* extends from an end of the attachment plate 49. A support shaft 62 projects from the wall 49***a* and rotatably supports a second gear 63. The second gear 63 is engaged with the motor gear 61.

The second gear 63 is engaged with the first gear 57. In the illustrated embodiment, the motor gear 61, the first gear 57, and the second gear 63 form a gear mechanism 64. Accordingly, the rotation of the pressurization motor 60 is transmitted by the gear mechanism 64 and converted to linear reciprocation by the cam mechanism 59, thus flexibly deforming the deformable member 50.

Figure 7:
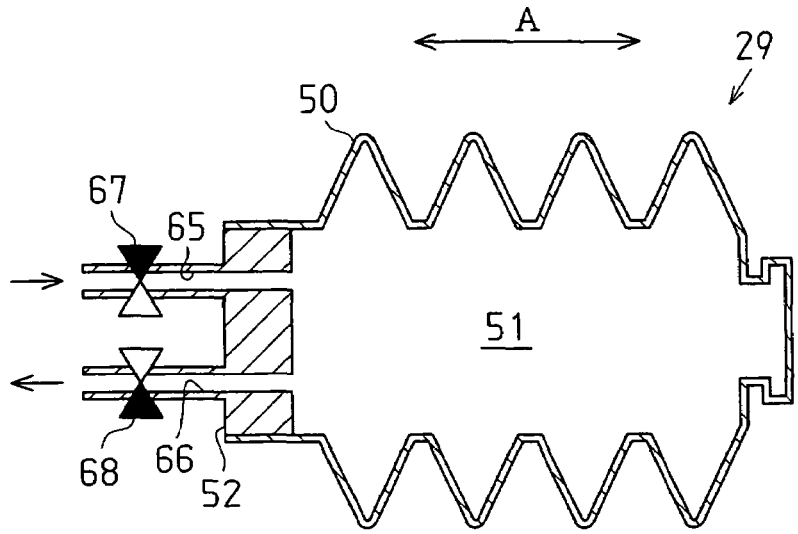
FIG. 7 is a cross-sectional view showing a deformable member of FIG. 6 held in an extended state.
Figure 8:
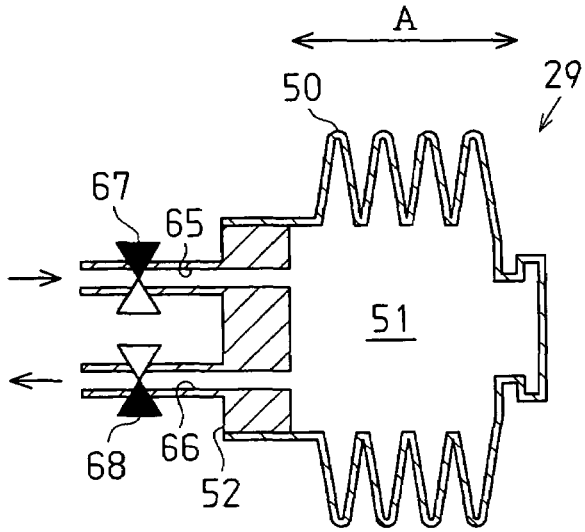
FIG. 8 is a cross-sectional view showing the deformable member of FIG. 7 held in a reduced state.

As shown in FIGS. 7 and 8, the seal portion 52 of the deformable member 50 has an air inlet line 65 and an air outlet line 66, which communicate with the air accumulation chamber 51. The air inlet line 65 has an end exposed to the atmospheric air. The air outlet line 66 communicates with the air outlet tube 53, which is connected to the seal portion 52. The air inlet line 65 includes an air inlet valve 67 formed by a one-way valve. The air inlet valve 67 permits the atmospheric air to flow only to the air accumulation chamber 51. The air outlet line 66 includes an air outlet valve 68 formed by a one-way valve. The air outlet valve 68 permits the atmospheric air to flow only from the air accumulation chamber 51.

When the gear mechanism 64 and the cam mechanism 59 operate to move the piston 56 toward the deformable member 50, the deformable member 50 flexibly deforms to a reduced state (air outlet operation) as shown in FIG. 8. The air is thus sent from the air accumulation chamber 51 to the air outlet tube 53 through the air outlet line 66. As the gear mechanism 64 and the cam mechanism 59 continuously operate to move the piston 56 separately from the deformable member 50, the deformable member 50 flexibly deforms to an extended state (air inlet operation) as shown in FIG. 7. The atmospheric air is thus introduced into the air accumulation chamber 51 through the air inlet line 65. By repeating the air inlet operation and the air outlet operation, the pressurization pump 29 introduces the air into each cartridge 21 through the air outlet tube 53 and thus increases the pressure in the air chamber 24 of the cartridge 21 in a stepped manner.

As shown in FIG. 6, the air outlet tube 53 is connected to the pressure sensor 30. The pressure sensor 30 detects the pressure of the air flowing from the pressurization pump 29 and outputs a detection value corresponding to the detected pressure. The pressure sensor 30 is connected to the open-to-air valve 31 through a communication tube 69.

The open-to-air valve 31 is arranged between the communication tube 69 and the air supply line 28 and has a valve opening lever 70. When the valve opening lever 70 is depressed, the open-to-air valve 31 operates to open the air supply line 28 with respect to the atmospheric air. Otherwise, the air supply line 28 is closed with respect to the atmospheric air. The air is thus supplied from the pressurization pump 29 to each cartridge 21 through the air supply line 28. Further, a non-illustrated valve opening mechanism is provided in the vicinity of the valve opening lever 70. The valve opening mechanism includes a gear mechanism connected to the pressurization motor 60 and a pressing member that presses the valve opening lever 70. The pressing member presses the valve opening lever 70 when the pressurization motor 60 rotates in a reverse direction.

Referring to FIG. 6, a home detector 71 is secured to the attachment plate 49 and in the vicinity of the pressing member 54 of the pressurization pump 29. The home detector 71 detects the position of the deformable member 50. The home detector 71 is formed by, for example, a limit switch or a photo sensor and includes a detection lever 72. When the deformable member 50 is deformed to a maximally extended state, or located at a home position, the detection lever 72 is retracted by the base 55 of the pressing member 54. This causes the home detector 71 to output a detection signal.

Hereinafter, the electric configuration of the inkjet printer 10 will be explained with reference to FIG. 9.

The inkjet printer 10 has a CPU 73, a ROM 74, a RAM 75, and an application specific integrated circuit (ASIC) 76 serving as a calculating section, a determining section, and a control section. These components are connected together through a bus 77. The CPU 73 performs a main control procedure in accordance with different control programs stored in the ROM 74 with the RAM 75 functioning as a work area. The inkjet printer 10 is connected to a host computer 79 through an interface, (I/F) 78. The inkjet printer 10 thus performs printing in accordance with printing data transmitted from the host computer 79.

The ROM 74 stores determination data used for determining the rotational speed (the operational speed) of the pressurization motor 60. In the determination data, the total ink remaining amount of the cartridges 21 are divided into a plurality of ranges by predetermined equal units (in this embodiment, by 2-gram units) in a stepped manner from a maximum value to a minimum value. The maximum value corresponds to an initial state in which all of the cartridges 21 are full. The minimum valve corresponds to a state in which the cartridges 21 are all empty. The rotational speed of the pressurization motor 60 is determined in advance for each of the ranges of the ink remaining amount. In the inkjet printer 10, regardless of the total ink remaining amount of the cartridges 21, the ink consumption amount in a single choke cleaning cycle is determined in correspondence with a fixed basic value that corresponds to the ink consumption amount of a single choke cleaning cycle performed in the initial state, or when all cartridges 21 are full.

More specifically, if the maximum valve of the total ink remaining amount is 20 grams and the unit for setting the ranges of the total ink remaining amount is two grams, the total ink remaining amount is divided into ten ranges of 20 to 18 grams, 18 to 16 grams, 16 to 14 grams . . . , and 2 to 0 grams, in this order from the maximum value to the minimum value. In correspondence with each of the ten ranges, the rotational speed of the motor 60 is set based on experiments or the like and in accordance with the types of the ink, the capacity of the air chamber 24 of each cartridge 21, and the performance of the pressurization pump 29.

For example, in the range of 20 to 18 grams of the total ink remaining amount, the rotational speed of the pressurization motor 60 is set to 2,500 rpm (a normal mode). In the range of 18 to 16 grams, the rotational speed of the pressurization motor 60 is set to 2,600 rpm (a high-speed mode). In this manner, the rotational speed of the pressurization motor 60 is set for each of the ranges of the total ink remaining amount. As the total ink remaining amount decreases, the rotational speed of the pressurization motor 60 increases. That is, in the normal mode, the pressurization motor 60 rotates at the speed of 2,500 rpm. In the high-speed mode, the rotational speed of the pressurization motor 60 increases from 2,600 to 3,400 rpm by a difference of 100 rpm for each of the corresponding ranges as the total ink remaining amount decreases.

The ASIC 76 operates as instructed by the CPU 73 and thus drives first, second, third, and fourth motor driver circuits 80, 81, 82, 83. The first motor driver circuit 80 drives the carriage motor 16. The second motor driver circuit 81 drives the paper feeder motor M2. The third motor driver circuit 82 drives the pressurization motor 60, or the drive source of the pressurization pump 29. In accordance with the signals from the ASIC 76, the pressurization motor 60 is operated (in correspondence with the high-speed mode) at a relatively high rotational speed, a first speed, or operated (in correspondence with the normal mode) at a relatively low rotational speed, a second speed.

The fourth motor driver circuit 83 drives the maintenance motor M4 provided in the maintenance unit 33. The ASIC 76 further operates the non-illustrated piezoelectric element of the recording head 17 through a head driver circuit 84. This causes the recording head 17 to perform ink ejection (liquid ejection) by ejecting ink droplets from the nozzles 19.

The ASIC 76 is electrically connected to the pressure sensor 30. The ASIC 76 thus calculates the pressure of the pressurized air in correspondence with a detection value sent from the pressure sensor 30. In accordance with the obtained pressure of the pressurized air, the pressurization motor 60 is controlled through the third motor driver circuit 82. The ASIC 76 is electrically connected also to the home detector 71. The ASIC 76 thus determines whether the deformable member 50 has reached the home position in accordance with a detection value sent from the home detector 71.

Figure 10:
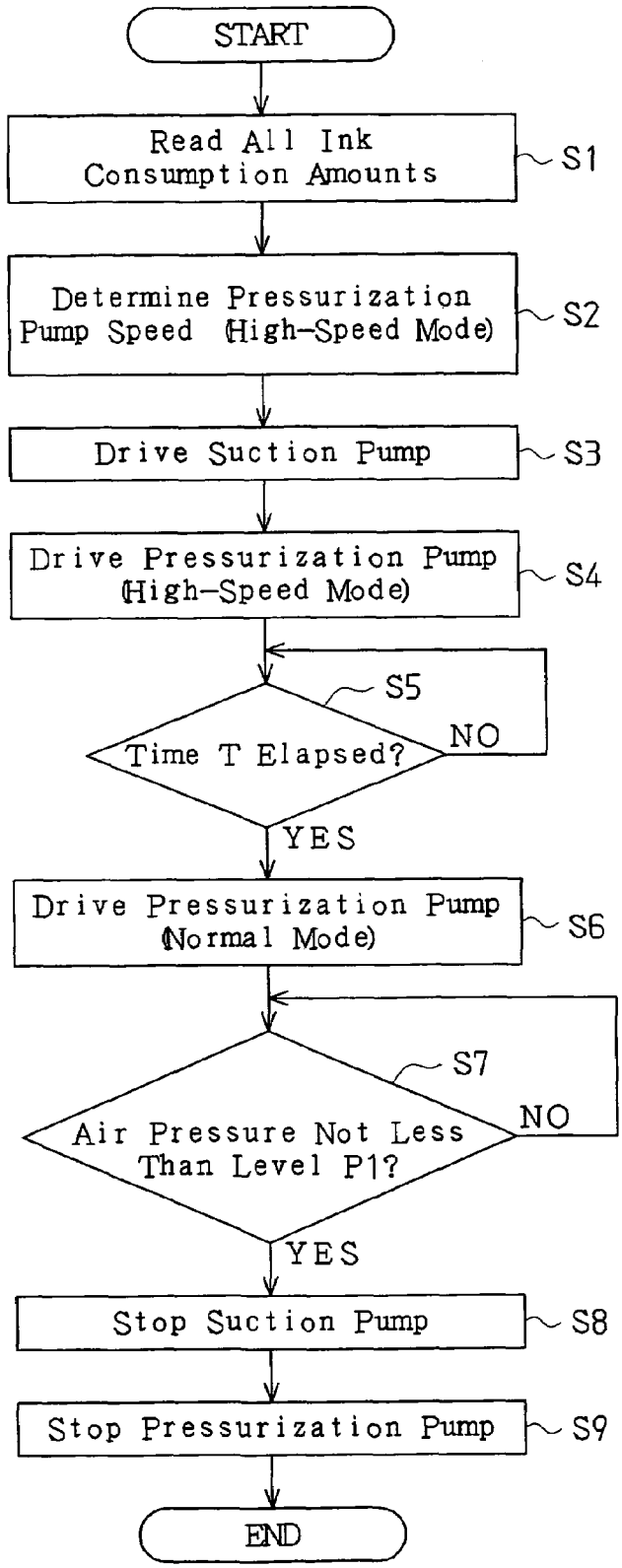
FIG. 10 is a flowchart representing a choke cleaning procedure for the printer of FIG. 1.

Next, a choke cleaning procedure for the inkjet printer 10 will be explained with reference to the flowchart of FIG. 10.

The ASIC 76 performs the choke cleaning when the inkjet printer 10 is maintained in a stand-by state with the carriage 14 held at the home position. The choke cleaning is carried out in accordance with a cleaning program stored in the ROM 74 at predetermined time intervals or in response to a signal from a manipulator 85 (see FIG. 9). The manipulator 85 is arranged in a non-illustrated outer casing that accommodates the frame 11.

More specifically, the ASIC 76 reads out the initial ink amount and a current ink consumption amount of the ink pack 23 of each cartridge 21 from the corresponding IC chip 25 (step S1). The ASIC 76 then totals the ink initial amounts and the current ink consumption amounts of all cartridges 21, thus obtaining a total initial ink amount and a total ink consumption amount, respectively. Subsequently, by subtracting the total ink consumption amount from the total initial ink amount, the ASIC 76 determines a current total ink remaining amount.

With reference to the determination data for the rotational speed (the operational speed) of the pressurization motor 60, which is stored in the ROM 74, the ASIC 76 determines which of the ranges the current total ink remaining amount falls in. The ASIC 76 thus extracts the rotational speed of the pressurization motor 60 corresponding to the determined range from the determination data. The extracted value is determined as the rotational speed of the pressurization motor 60 (in the high-speed mode) for the current cycle of choke cleaning. The operational speed of the pressurization pump 29 is also determined automatically based on the determined rotational speed of the pressurization motor 60 (step S2).

Subsequently, the ASIC 76 actuates the maintenance motor M4 through the fourth motor driver circuit 83, thus activating the suction pump 37 (step S3). By this time, the cap 34 has been moved by the lift mechanism 38 to an operational position at which the cap 34 contacts the lower surface of the recording head 17. Thus, the ink is drawn from the recording head 17 and the valve units 18 located upstream from the recording head 17, reducing the amount of the ink in each of the pressure chambers 46. This causes the film 45 in each pressure chamber 46 to contact the projection 43, closing the outlet line 44. The choke valve 47 of each valve unit 18 is thus closed. Meanwhile, negative pressure accumulates in a downstream side from each pressure chamber 46.

Next, the ASIC 76 rotates the pressurization motor 60 in a positive direction at the rotational speed (corresponding to the high-speed mode) determined in step S2, thus activating the pressurization pump 29 (step S4). The ASIC 76 then determines, in accordance with measurement of a non-illustrated timer, whether a predetermined time T has elapsed after starting of the pressurization motor 60 (step S5). The time T is defined as the time from when the pressurization motor 60 is started to when the force that is generated by the ink sent from each cartridge 21 and acts to separate the film 45 from the projection 43 exceeds the force produced by the negative pressure that holds the choke valve 47 in a closed state. In other words, the time T corresponds to the time from when the pressurization motor 60 is started to when the pressure of the ink sent from each cartridge 21 reaches a level sufficiently high for opening the choke valve 47, which is held in the closed state.

If it is determined in step S5 that the time T has not yet elapsed (NO in step S5), the ASIC 76 repeats step S5. If it is determined that the time T has elapsed (YES in step S5), it is indicated that the force produced by the ink sent from each cartridge 21, which acts to separate the film 45 from the projection 43, exceeds the force generated by the negative pressure in the downstream side from the pressure chamber 46, which acts to press the film 45 against the projection 43. The film 45 in each pressure chamber 46 thus separates from the projection 43, and the choke valve 47 thus becomes open. The time from when the pressurization motor 60 is started to when each choke valve 47 becomes open is substantially constant, regardless of the ink remaining amount of the corresponding ink pack 23. Further, opening of the choke valve 47 causes the ink to rapidly flow into the downstream side from each pressure chamber 46. Thus, as soon as the choke valves 47 become open, the rotational speed (the operational speed) of the pressurization motor 60 is switched from the high-speed mode to the normal mode (step S6).

In step S6, regardless of the rotational speed (the operational speed) of the pressurization motor 60 that has been switched to the normal mode, the ink sent from each cartridge 21 rapidly flows downstream due to the pressure difference caused in the liquid supply line. The flow rate of the ink flowing into a downstream side from each choke valve 47 is thus maintained without being reduced. Further, even with the suction pump 37 running, the ink is sent from each cartridge 21 to the corresponding pressure chamber 46 by continuously supplying the pressurized air from the pressurization pump 29. Each of the choke valves 47 is thus maintained in the open state.

Subsequently, in correspondence with the detection value of the pressure sensor 30, the ASIC 76 determines whether the pressure of the pressurized air supplied to the air chamber 24 of each cartridge 21 through an air passage, which is formed by the air outlet tube 53, the communication tube 69, and the air supply line 28, is greater than or equal to a predetermined level P1 (step S7). The level P1 is defined as a level of pressure sufficiently high for sending the ink from each ink pack 23 to the ink supply line 26 by squeezing the ink pack 23. If the pressure of the pressurized air is lower than the level P1 (NO in step S7), the ASIC 76 repeats step S7 at predetermined constant time intervals. If the pressure of the pressurized air is greater than or equal to the level P1 (YES in step S7), the ASIC 76 deactivates the maintenance motor M4 and thus stops the suction pump 37 (step S8).

The ASIC 76 then deactivates the pressurization motor 60 and thus stops the pressurization pump 29 (step S9). More specifically, before being deactivated, the pressurization motor 60 is rotated in a negative direction until the deformable member 50 is extended to the home position. After stopping the pressurization motor 60, the ASIC 76 adds a predetermined ink consumption amount per cycle of choke cleaning to the current total of the ink consumption amount of each of the IC chips 25 (that is currently stored by each IC chip 25). The obtained sum is then recorded in each IC chip 25.

In step S2, if all cartridges 21 are full, or correspond to the initial states, the rotational speed of the pressurization motor 60 is set to the level of the normal mode. In this case, the pressurization motor 60 is activated in the normal mode in step S4. Subsequently, the ASIC 76 executes step S7 without performing steps S5 or S6.

Accordingly, by performing the choke cleaning when needed, the bubbles and the impurities are removed from the liquid supply line (the ink supply line 26, the inlet line 42, the recess 41, and the outlet line 44) and the recording head 17. The ink is thus reliably supplied to the liquid supply line.

The illustrated embodiment has the following advantages.

(1) If the ink remaining amount of each ink pack 23 decreases, the volume of the corresponding air chamber 24, which receives the pressurized air, increases. This lowers the pressurization efficiency of the pressurization pump 29 with respect to the ink packs 23. Thus, particularly for the choke cleaning, the rotational speed (the operational speed) of the pressurization motor 60 is determined in correspondence with the ink remaining amount for each cycle of the choke cleaning. In other words, the rotational speed of the pressurization motor 60 is determined in correspondence with the lowered pressurization efficiency of the pressurization pump 29 with respect to the ink packs 23. The pressurization motor 60 is thus activated at this speed. This reduces the difference between the actual ink consumption amount of the choke cleaning cycle and the added (recorded) ink consumption amount. The ink is thus consumed efficiently.

(2) The rotational speed of the pressurization motor 60 is set for each of the ranges of the ink remaining amount in the determination data that is stored in the ROM 74. The rotational speed of the pressurization motor 60 is thus easily extracted from the determination data in accordance with the range in which the current ink remaining amount falls. Accordingly, particularly in the choke cleaning, the difference between the actual ink consumption amount of the choke cleaning cycle and the added ink consumption amount is easily reduced by actuating the pressurization motor 60 at the speed extracted from the determination data.

(3) The rotational speed of the pressurization motor 60 is determined in correspondence with the total ink remaining amount of the cartridges 21. In the choke cleaning, the ink is drawn collectively from all nozzles 19 of the recording head 17 by supplying the pressurized air to the recording head 17 by the single pressurization pump 29. The rotational speed of the pressurization motor 60 for such operation is easily determined in the illustrated embodiment.

(4) The rotational speed (the operational speed) of the pressurization motor 60 is switched from the high-speed mode to the normal mode, or lowered, when the choke valves 47 become open. This allows the choke valves 47 to quickly become open and suppresses noise generation by the pressurization motor 60 once the choke valves 47 are open.

It should be apparent to those skilled in the art that the present invention may be embodied in many other specific forms without departing from the spirit or scope of the invention. Particularly, it should be understood that the invention may be embodied in the following forms.

The valve units 18 may be omitted, so that the ink is supplied from the ink supply line 26 directly to the recording head 17. Also in this case, by activating the suction pump 37 with the nozzles 19 of the recording head 17 sealed by the cap 34, the ink is drawn and drained from the recording head 17 so as to clean the recording head 17.

By employing the cleaning method of the illustrated embodiment for the inkjet printer 10, selective cleaning may be performed. That is, suction of the ink is carried out only for a selected one of the nozzles 19.

Figure 11:
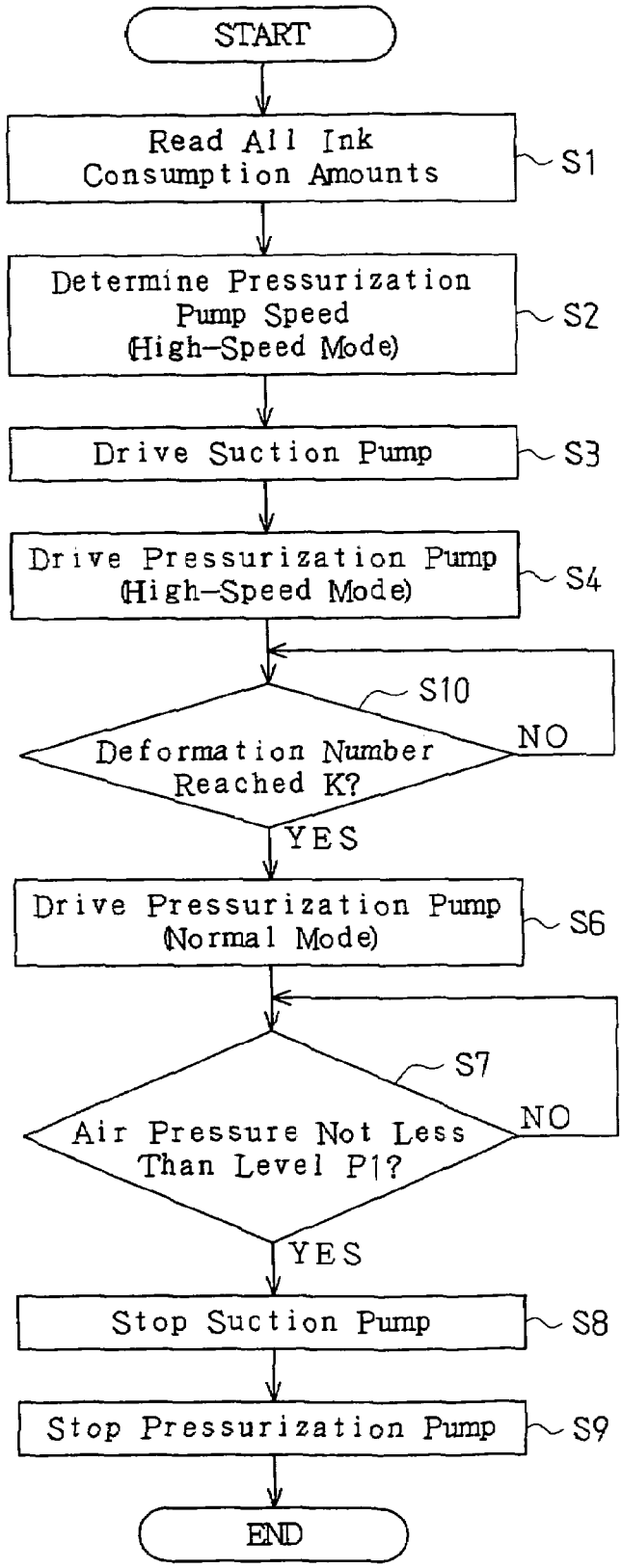
FIG. 11 is a flowchart representing a modified choke cleaning procedure for the printer of FIG. 1.

The procedure of step S5 of the illustrated embodiment may be replaced by a procedure of step S10 of FIG. 11. In this step, it is determined whether the number of deformation cycles (the deformation number) of the deformable member 50 has reached a predetermined number K. The number K is defined as a value at which the force that is generated by the ink from each cartridge 21 and acts to separate the film 45 from the projection 43 exceeds the force generated by the negative pressure of the suction pump 37 that acts to hold each choke valve 47 in a closed state.

Figure 12:
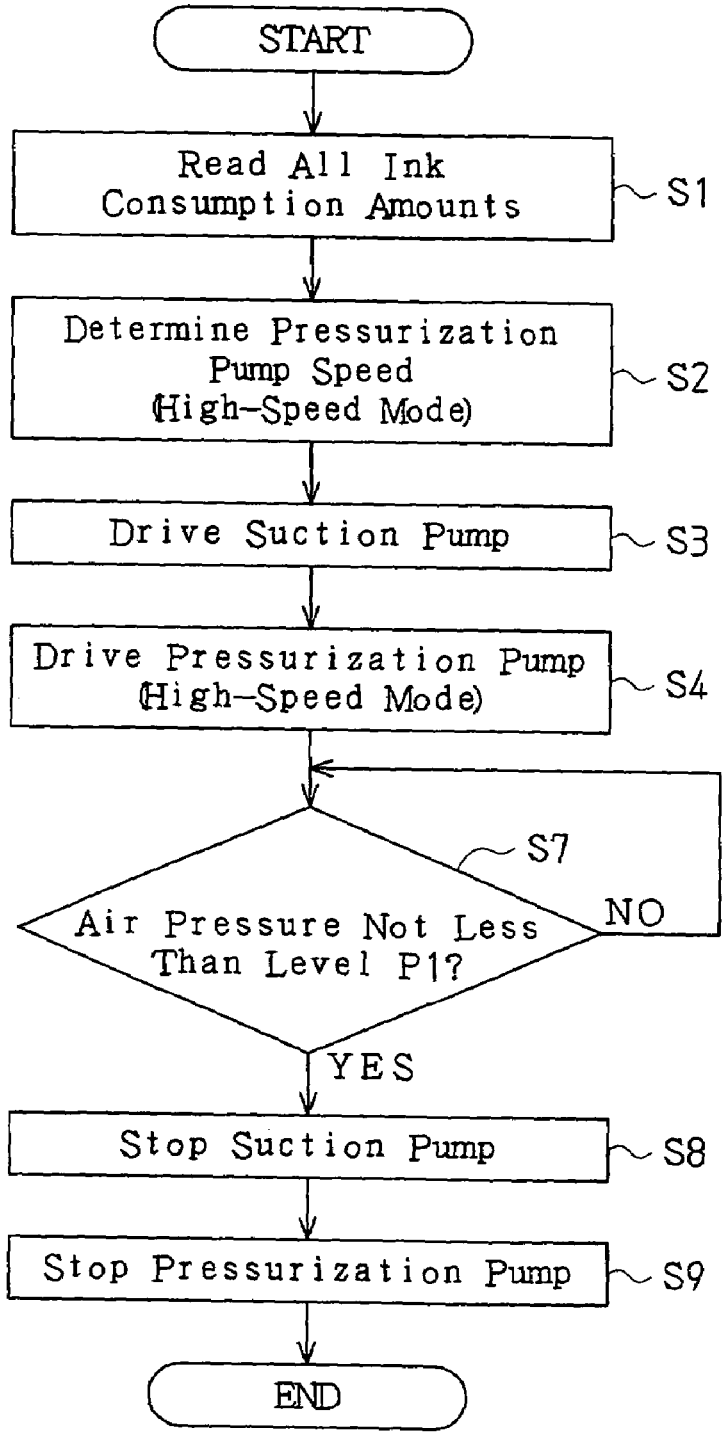
FIG. 12 is a flowchart representing another modified choke cleaning procedure for the printer of FIG. 1.

Referring to FIG. 12, the procedures of steps S5 and S6 of the illustrated embodiment may be omitted. In this case, the rotational speed of the pressurization motor 60 remains unchanged from the value determined in step S2.

In step S2 of the illustrated embodiment, the rotational speed of the pressurization motor 60 may be calculated by using, for example, a coefficient N determined through experiments.

The choke valves 47 may be arranged at positions other than those in the valve units 18 as long as the choke valves 47 are provided in the liquid supply line (for example, the ink supply line 26) extending from the cartridges 21 to the nozzles 19 of the recording head 17.

The inkjet printer 10 may include a single cartridge 21 or multiple cartridges 21 in a number other than four.

In the illustrated embodiment, the liquid ejection apparatus is embodied as the inkjet printer 10. However, the liquid ejection apparatus may be embodied as an apparatus used in, for example, the manufacture of color filters of liquid crystal displays or pigments of organic EL displays.

Therefore, the present examples and embodiments are to be considered as illustrative and not restrictive and the invention is not to be limited to the details given herein, but may be modified within the scope and equivalence of the appended claims.

What is claimed is:

1. A method for cleaning a liquid ejection apparatus having a liquid ejection head that ejects liquid through a nozzle, the liquid being sent from a liquid retainer to the liquid ejection head via a liquid supply line by pressurization force generated by a pressurization device that is driven by a driver, the method comprising:

drawing the liquid from the liquid ejection head through the nozzle by a suction device;

obtaining a liquid remaining amount of the liquid retainer;

determining an operational speed of the driver in correspondence with the liquid remaining amount of the liquid retainer; and operating the driver at the determined operational speed when drawing the liquid by the suction device.

2. The method according to claim 1, wherein a pressure difference open-close valve is provided in the liquid supply line, the method further comprising:

closing the pressure difference open-close valve by suction force generated by the suction device when the liquid is drawn from the liquid ejection head through the nozzle;

depressurizing a section of the liquid supply line downstream from the pressure difference open-close valve; and opening the pressure difference open-close valve by the pressure of the liquid generated by the pressurization force of the pressurization device with a section of the liquid supply line downstream from the pressure difference open-close valve held in a depressurized state.

3. The method according to claim 1 further comprising:

increasing the operational speed of the driver as the liquid remaining amount of the liquid retainer decreases.

4. The method according to claim 1, wherein the liquid retainer is one of a plurality of liquid retainers, the method further comprising:

determining the operational speed of the driver based on a total liquid remaining amount of the liquid retainers.

5. The method according to claim 1, wherein the determined operational speed of the driver is a first speed, the method further comprising:

operating the driver at the first speed and then switching the operational speed of the driver to a second speed lower than the first speed when drawing the liquid through the nozzle.

6. The method according to claim 5, wherein the pressurization device is a bellows type pump having an air accumulation chamber and a bellows defining the air accumulation chamber, the method further comprising:

generating pressurized air by deforming the bellows in such a manner as to selectively decrease and increase the volume of the air accumulation chamber;

supplying the pressurized air to the liquid retainer; and changing the speed for deforming the bellows in correspondence with the operational speed of the driver.

7. The method according to claim 6 further comprising:

operating the driver at the first speed until the number of deformation cycles of the bellows reaches a predetermined number, and then switching the operational speed of the driver to the second speed.

8. The method according to claim 7, wherein the predetermined number of the deformation cycles of the bellows corresponds to the number of the deformation cycle in which the pressure of the liquid sent from the liquid retainer at least reaches a level necessary for opening the pressure difference open-close valve after operation of the driver is started.

9. The method according to claim 5 further comprising:

operating the driver at the first speed for a predetermined time and then switching the operational speed of the driver to the second speed.

10. The method according to claim 9, wherein the predetermined time corresponds to a period from when operation of the driver is started to when the pressure of the liquid sent from the liquid retainer at least reaches a level necessary for opening the pressure difference open-close valve.

11. A liquid ejection apparatus comprising:

a liquid retainer;

a liquid ejection head having a nozzle through which liquid is ejected and a nozzle surface in which an opening of the nozzle is defined;

a liquid supply line extending from the liquid retainer to the liquid ejection head;

a pressurization device for pressurizing the liquid so as to introduce the liquid from the liquid retainer into the liquid supply line and thus eject the liquid from the liquid ejection head;

a driver for driving the pressurization device;

a seal device for sealing the nozzle surface;

a suction device for drawing the liquid from the liquid supply line and the liquid ejection head through the seal device;

a calculating section for calculating a liquid remaining amount of the liquid retainer;

a determining section for determining an operational speed of the driver based on a result of the calculation by the calculating section; and a control section for controlling the driver at the determined operational speed when the liquid is drawn by the suction device.

12. An inkjet printer comprising:

a cartridge;

a recording head having a nozzle through which ink is ejected and a nozzle surface in which an opening of the nozzle is defined;

an ink supply line extending from the cartridge to the recording head;

a pressurization pump for pressurizing the ink so as to introduce the ink from the cartridge into the ink supply line and thus eject the ink from the recording head;

a pressurization motor for driving the pressurization pump;

a cap for sealing the nozzle surface;

a suction pump for drawing the ink from the ink supply line and the recording head through the cap; and a control section for controlling the pressurization motor, wherein the control section calculates an ink remaining amount of the cartridge, determines an operational speed of the pressurization motor based on a result of the calculation, and operates the pressurization motor at the determined operational speed when the ink is drawn by the suction pump.

* * * * *